US008677546B1

(12) United States Patent
Kholodny et al.

(10) Patent No.: US 8,677,546 B1
(45) Date of Patent: Mar. 25, 2014

(54) LUFFA SPONGE WITH ROPE HANDLES

(71) Applicants: Joseph Kholodny, Plainview, NY (US); Paul Kholodny, New York, NY (US)

(72) Inventors: Joseph Kholodny, Plainview, NY (US); Paul Kholodny, New York, NY (US)

( * ) Notice: Subject to any disclaimer, the term of this patent is extended or adjusted under 35 U.S.C. 154(b) by 0 days.

(21) Appl. No.: 13/920,882

(22) Filed: Jun. 18, 2013

(51) Int. Cl.
*A47K 7/02* (2006.01)

(52) U.S. Cl.
USPC ..... 15/222

(58) Field of Classification Search
USPC ..... 15/222, 209.1, 210.1, 244.3; 401/8; 300/21
See application file for complete search history.

(56) References Cited

U.S. PATENT DOCUMENTS

| | | | | |
|---|---|---|---|---|
| 2,156,940 | A * | 5/1939 | Graham | 401/8 |
| D655,504 | S * | 3/2012 | Barlier | D3/303 |
| 2007/0065224 | A1 * | 3/2007 | Shaw | 401/201 |

* cited by examiner

*Primary Examiner* — Robert Scruggs
(74) *Attorney, Agent, or Firm* — Charlena Thorpe, Esq.; F. Wayne Thompson, Jr.; The Law Office of Charlena Thorpe, Inc.

(57) ABSTRACT

In implementations of the present disclosure, one or more ropes can be inserted along the length of one or more natural openings of a luffa to create a luffa sponge having rope handles.

6 Claims, 3 Drawing Sheets

LUFFA SPONGE WITH ROPE HANDLES

TECHNICAL FIELD

This disclosure relates to implementations of a luffa sponge with rope handles.

BACKGROUND

In some implementations of existing luffa (or loofah) sponge brushes, a luffa or a part thereof is attached to a thick, long handle. In use, the luffa may rip from the handle. In other implementations of existing luffa sponge brushes, the brush is fabricated by cutting a thin layer of luffa and attaching the layer of luffa to a fabric. These brushes have a short duration because of the thin layer of luffa.

DETAILED DESCRIPTION

In implementations of the present disclosure, one or more ropes can be inserted along the length of one or more natural openings of a luffa to create a luffa sponge having rope handles. In some implementations, the one or more ropes can be substituted with one or more cords, lines, strings, or twines. In some implementations, the one or more ropes can be substituted with one or more ribbons. In some implementations, the one or more ropes can be substituted with any linearly constructed material made of any material such as, but not limited to, natural or synthetic fibres such as linen, cotton, polypropylene, nylon, polyesters, silk, wool, rayon or any other material. In some implementations, a luffa may be substituted with a natural sea sponge, synthetic sea sponge, or any other sponge. For those sponges that do not have natural openings, one or more openings can be formed along the length of the sponges. In some implementations, the distance between the one or more openings can be ⅓ the width of the sponge. In some implementations, the one or more openings are centered between the top surface and bottom surface of the sponge.

Implementations of luffa sponges with handles of the present disclosure may have a longer duration than existing luffa sponges with handles. The handles of the luffa sponges of the present disclosure may rip less easily from the luffa sponges than the handles of existing luffa sponges. The thickness of the luffa sponges with handles of the present disclosure may be thicker than some existing luffa sponges.

Figure 1:
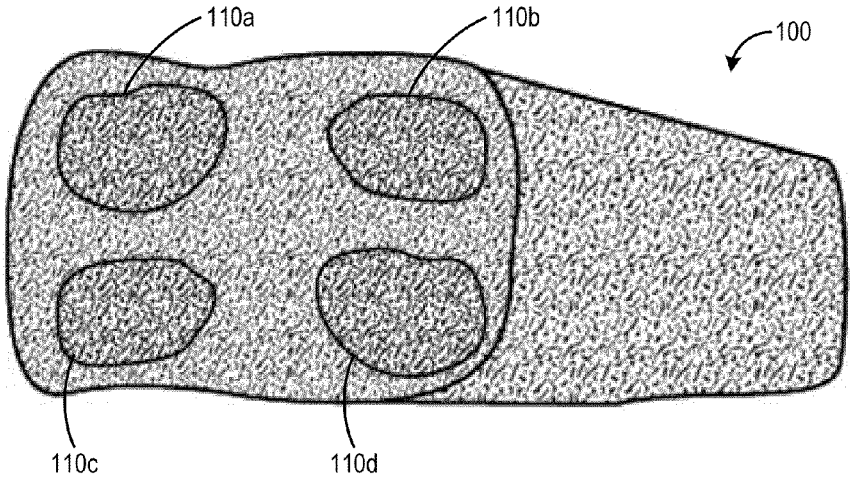
FIG. 1 illustrates an example luffa.

FIG. 1 illustrates an example luffa 100 that may be used as a scrubbing sponge. A fully developed luffa generally has a cylindrical shape and typically ranges from 10 inches to 30 inches long. However, the luffa 100 can be smaller or larger. A typical luffa may have four natural openings (e.g., openings 110*a-d* of FIG. 1) extending along its length. In implementations of the present disclosure, one or more ropes (or other linear construction) can be inserted along the length of one or more openings (e.g., openings 110*a-d*) of a luffa (e.g., luffa 100) to create a luffa sponge having rope handles.

Figure 2:
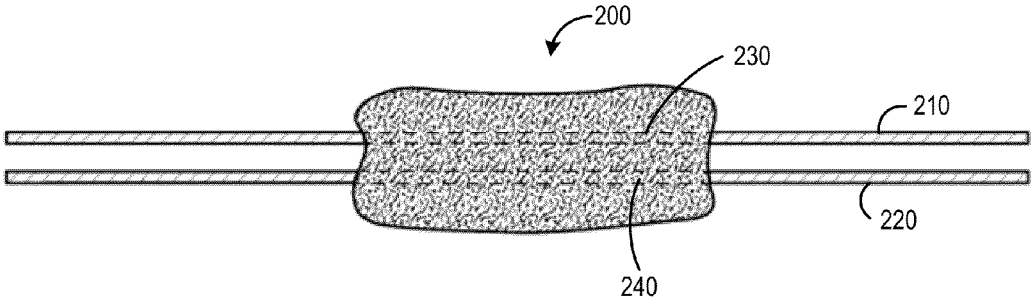
FIGS. 2-4 illustrate an example method of making a luffa sponge having rope handles.
Figure 3:
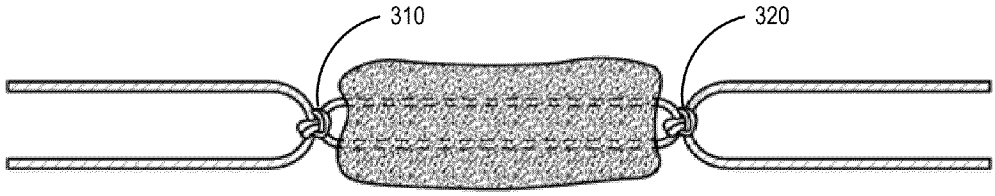
Figure 4:
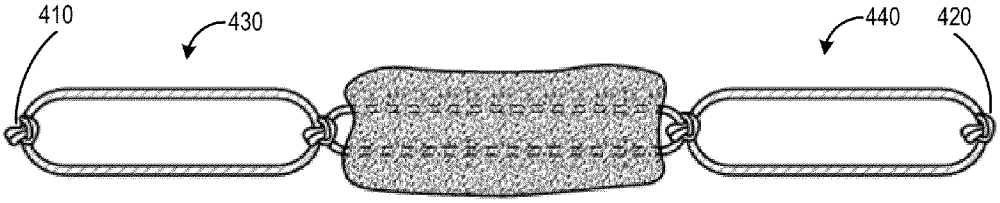

FIGS. 2-4 illustrate an example method of making a luffa sponge having rope handles. As shown in FIG. 2, two ropes 210, 220 are inserted along the length of two openings 230, 240, respectively, of a luffa 200. In some implementations, the ropes 210, 220 are 3 ft to 4 ft long. However, the ropes 210, 220 can be shorter or longer. In implementations of the present disclosure, the two ropes 210, 220 can be inserted into any combination of two holes of the luffa. For example, referring to FIG. 1, the two ropes 210, 220 can be inserted into openings 110*a* and 110*b*, respectively; 110*a* and 110*c*, respectively; 110*a* and 110*d*, respectively; 110*b* and 110*c*, respectively; 110*b* and 110*d*, respectively; or 110*c* and 110*d*, respectively.

As shown in FIG. 3, the two ropes then are used to form a first set of knots 310, 320 near the ends of the luffa respectively. In some implementations, the knots 310, 320 are formed at or near the ends of the luffa. In some implementations, the knots are positioned some distance from the ends of the luffa. In some implementation, the knots are positioned to be equidistant from the respective ends of the luffa. In some implementation, the knots 310, 320 can be formed sufficiently near the ends of the luffa such that length of rope from each knot 310, 320 to the closest end of the ropes, respectively, is at least 10 inches to 15 inches long. However, the length can be smaller or larger.

As shown in FIG. 4, to create handles 430, 440, the ends of the two ropes then are used to form a second set of knots 410, 420. In some implementations, the second set of knots 410, 420 can be formed near the ends of the two ropes. In some implementations, the distance between the first set of knots and the second set of knots can be 10 inches to 15 inches. However, the distance can be shorter or longer.

Figure 5:
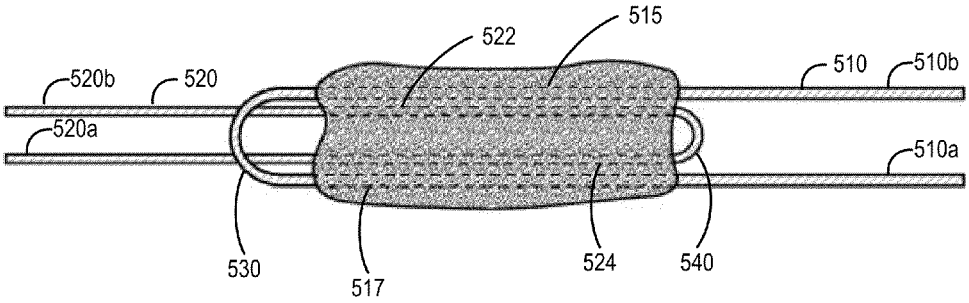
FIGS. 5-7 illustrate another example method of making a luffa sponge having rope handles.
Figure 6:
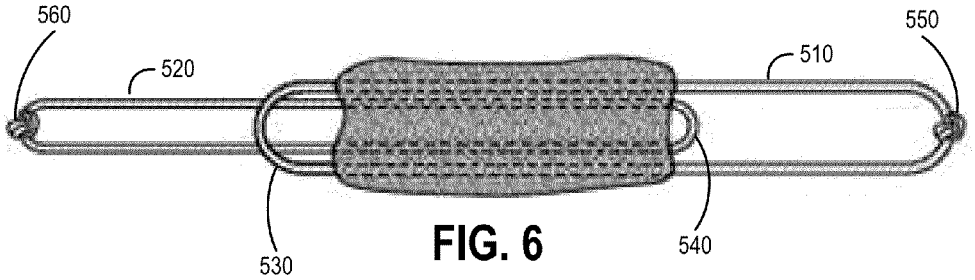
Figure 7:
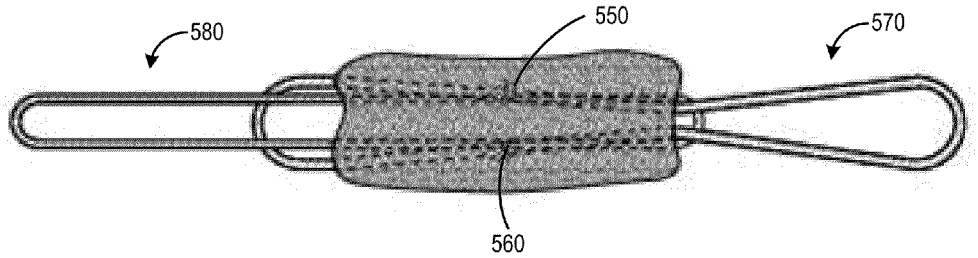

FIGS. 5-7 illustrate another example method of making a luffa sponge having rope handles. In this example, four luffa openings are used. As shown in FIG. 5, a first end 510*a* of a first rope 510 is inserted along the length of a first opening 515 of a luffa in a first direction and then inserted along the length of a second opening 517 of the luffa in an opposite, second direction thereby forming a loop 530 at a first end of the luffa. Then, a first end 520*a* of a second rope 520 is inserted along the length of a third opening 522 of a luffa in the second direction and then inserted along the length of a fourth opening 524 of the luffa in the opposite, first direction thereby forming a loop 540 at a second end of the luffa.

Referring to FIG. 6, the ends of the first rope 510*a, b* are used to form a first knot 550, e.g., near the ends of the first rope 510. The ends of the second rope 520*a, b* then are used to form a second knot 560, e.g., near the ends of the second rope 520. In some implementations, the knots 550, 560 can be 10 inches to 15 inches from the closest end of the luffa. However, the knots 550, 560 can be closer or farther.

Referring to FIG. 7, in some implementations, the knots 550, 560 can be hidden inside the luffa by rotating the ropes.

To create handles 570, 580, rope 510 can inserted in loop 540 at a second end of the luffa to form a handle 570 and rope 520 can be inserted in loop 530 at the first end of the luffa to form a handle 580.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A method comprising:

inserting a first end of a first linearly constructed material along the length of a first opening of a sponge in a first direction and then inserting the first end of the first linearly constructed material along the length of a second opening of the sponge in an opposite, second direction thereby forming a first loop at a first end of the sponge;

inserting a first end of a second linearly constructed material along the length of a third opening of a sponge in the second direction and then inserting the first end of the second linearly constructed material along the length of a fourth opening of the sponge in the opposite, first direction thereby forming a second loop at a second end of the sponge;

forming a first knot using the ends of the first linearly constructed material;

forming a second knot using the ends of the second linearly constructed material;

inserting the first linearly constructed material in the second loop; and inserting the second linearly constructed material in the first loop.

2. The method of claim 1 further comprising after forming the first and second knots rotating the first and second linearly constructed material until the first and second knots are concealed inside the sponge.

3. The method of claim 1 wherein the first, second, third and fourth openings are natural openings of a sponge.

4. The method of claim 1 wherein the first, second, third and fourth openings are manmade openings of a sponge.

5. The method of claim 1 wherein the sponge is a luffa.

6. The method of claim 1 wherein the first and second linearly constructed materials are first and second ropes.

* * * * *